US008960154B2

(12) United States Patent
Mason et al.

(10) Patent No.: US 8,960,154 B2
(45) Date of Patent: Feb. 24, 2015

(54) ELECTRONIC FUEL CONTROL SYSTEM

(75) Inventors: John Mason, Tralee (IE); Alan Harding, Stoney Stanton (GB)

(73) Assignee: Barcarole Limited, Cork (IE)

( * ) Notice: Subject to any disclaimer, the term of this patent is extended or adjusted under 35 U.S.C. 154(b) by 299 days.

(21) Appl. No.: 13/427,974

(22) Filed: Mar. 23, 2012

(65) Prior Publication Data

US 2012/0272936 A1 Nov. 1, 2012

(30) Foreign Application Priority Data

Mar. 23, 2011 (IE) ..... S2011/0135

(51) Int. Cl.

| | |
|---|---|
| ***F02M 7/23*** | (2006.01) |
| ***F02M 19/02*** | (2006.01) |
| ***F02D 35/00*** | (2006.01) |
| ***F02M 17/04*** | (2006.01) |

(52) U.S. Cl.

CPC ..... *F02M 19/02* (2013.01); *F02D 35/0069* (2013.01); *F02M 17/04* (2013.01)

USPC ..... 123/438

(58) Field of Classification Search

CPC ..... F02D 35/0069; F02M 17/04; F02M 19/02

USPC ..... 123/73 A, 73 AD, 357, 364, 379, 437, 123/438; 261/36.2, 70, 119.2

See application file for complete search history.

(56) References Cited

U.S. PATENT DOCUMENTS

| | | | | | |
|---|---|---|---|---|---|
| 4,411,233 | A | * | 10/1983 | Chenet et al. | 123/439 |
| 4,577,597 | A | * | 3/1986 | Tomita | 123/73 A |
| 5,632,248 | A | * | 5/1997 | Sugii | 123/438 |
| 5,715,789 | A | * | 2/1998 | Naruke et al. | 123/320 |
| 5,718,204 | A | * | 2/1998 | Sugii | 123/438 |
| 5,775,300 | A | * | 7/1998 | Sugii | 123/438 |
| 5,794,593 | A | * | 8/1998 | Sugii | 123/438 |
| 8,335,629 | B2 | * | 12/2012 | Carlsson et al. | 701/103 |

* cited by examiner

*Primary Examiner* — Hai Huynh

(74) *Attorney, Agent, or Firm* — Warner Norcross & Judd LLP

(57) ABSTRACT

The present invention is concerned with an electronic fuel control system including a carburettor having a throttle bore, a fuel chamber, and at least one fuel circuit extending between the fuel chamber and the throttle bore and controlled by an adjustment member such as a needle, the control system further including an actuator operable to automatically adjust the adjustment member in response to one or more engine operating parameters.

12 Claims, 4 Drawing Sheets

ELECTRONIC FUEL CONTROL SYSTEM

FIELD OF THE INVENTION

The present invention relates to an electronic fuel control system for adjusting fuel flow through a carburettor to an engine, and is especially but not exclusively applicable to a carburettor for supplying fuel to two or four stroke engines designed for use on, for example, chain saws, concrete saws, trimmers, lawn mowers, go-karts, motor cars, race cars, motorcycles and aircraft.

BACKGROUND OF THE INVENTION

A diaphragm-type carburettor comprises a main body portion defining a carburettor mixing passage or bore having an air intake side and an engine outlet side, fuel pump means, a throttle shutter mounted within the carburettor mixing passage between the air intake side and the engine outlet side, a throttle shaft for controlling the throttle shutter, and a metering chamber for supplying fuel from the fuel pump means into the carburettor mixing passage via a high-speed adjusting screw and a low speed/idle adjusting screw.

In such a carburettor the volume of fuel delivered to engine is adjustable, for low speed operation via low speed/idle adjustment screw and for high-speed operation via the high-speed adjustment screw.

Adjustment is factory set by the engine manufacturer to give the desired engine performance/air fuel ratios.

With such a system, adjustment can be made within a broad band from no fuel flow, when the adjustment needle is screwed fully in (i.e. the needle tip closes the orifice) to fully open, when the needle tip is fully out of the orifice. In this case the orifice diameter controls the maximum volume of fuel flow. This system allows the engine to be set to run on a very lean or very rich fuel fixture. More often the factory setting is re-adjusted by the end user because of acceleration problems due to the carburettor supplying insufficient fuel on acceleration and or altitude conditions where by the engine runs lean or rich due to the altitude. This arises from the inertia of moving components and machining in the carburettor, as well as high temperatures, pressures and vibration from the engine to which the carburettor is fitted. If sufficient fuel is supplied for acceleration, this can lead to an over supply at other times, causing engine performance problems in start-up, warm-up, lower and part throttle positions.

It is an object of the present invention to provide an electronic control system for a carburettor in which the above problem can be avoided.

This invention addresses the above problem by providing a fuel control system for a carburettor which has the ability to supply the correct quantity of fuel when required throughout the full range of operation or may be set to cover only a particular section of the full range of operation, primarily allowing the engine to have stable operation.

SUMMARY OF THE INVENTION

According to the present invention there is provided an electronic fuel control system comprising a carburettor comprising a throttle bore, a fuel chamber, at least one fuel circuit extending between the fuel chamber and the throttle bore and controlled by an adjustment member; and an actuator operable to automatically adjust the adjustment member in response to one or more engine operating parameters.

Preferably, the at least one fuel circuit comprises an idle fuel circuit extending between the fuel chamber and the throttle bore and controlled by an idle speed adjustment member, and a high-speed fuel circuit extending between the fuel chamber and the throttle bore and controlled by a high-speed adjustment member.

Preferably, the carburettor comprises a diaphragm carburettor.

Preferably, the fuel control system comprises a controller adapted to receive information regarding the one or more engine parameters and to effect operation of the actuator based on the received information.

Preferably, the actuator comprises a motor, a first lever driven by the motor, a second lever driving the at least one adjustment member, and a link connecting the first and second levers together.

Preferably, the fuel control system comprises one or more sensors adapted to receiving and transmit information regarding the one or more operating parameters to the controller.

Preferably, the at least one adjustment member is operable to selectively expose/occlude an orifice in order to meter the flow of a fluid through the orifice.

Preferably, the fuel control system comprises an override operable to enable a reset of the at least one adjustment member to a predetermined position.

Preferably, the override is adapted to manually and/or automatically deactivate the controller.

Preferably, the actuator is biased to return the at least one adjustment member to a predetermined position.

Preferably, the carburettor comprises a choke.

Preferably, the choke is operable by the controller.

Preferably, the choke is remote from the carburettor.

As used herein, the term "engine operating parameters" is intended to mean parameters such as engine temperature, engine speed, exhaust conditions and the like, in addition to external conditions such as environmental conditions like air temperature, pressure, humidity, etc, which can have a bearing on the operation of an engine.

BRIEF DESCRIPTION OF THE DRAWINGS

The invention will be understood in greater detail from the following description of a preferred embodiment of the invention given by way of example only and with reference to the accompanying drawings, in which.

DETAILED DESCRIPTION OF THE DRAWINGS

Referring now to the accompanying drawings there is illustrated an electronic fuel control system for an engine E, for example a single piston two-stroke engine as used in a chainsaw, concrete saw, trimmers, lawnmower or the like. It will however be appreciated from the following description of the configuration and operation of the fuel control system 10 that it is equally applicable to any other suitable carburettor based engine and/or multi carburettor and/or multi cylinder engines (not shown).

The fuel control system 10 comprises a carburettor 12 secured to the engine E in conventional fashion. In the embodiment illustrated the carburettor 12 is a diaphragm type carburettor, although it will again be understood that any other suitable form of carburettor, for example a conventional float type carburettor or the like may be used. The fuel control system 10 further comprises an electronic controller 14 which is operable, as will be described hereinafter in detail, to receive data regarding one or more engine operating parameters, and to use this data to control, via an actuator 16, fuel metering in the carburettor 12. The data may be supplied to the controller 14 by any suitable means, for example through wired or wireless connections or the like, as will be described.

Figure 1:
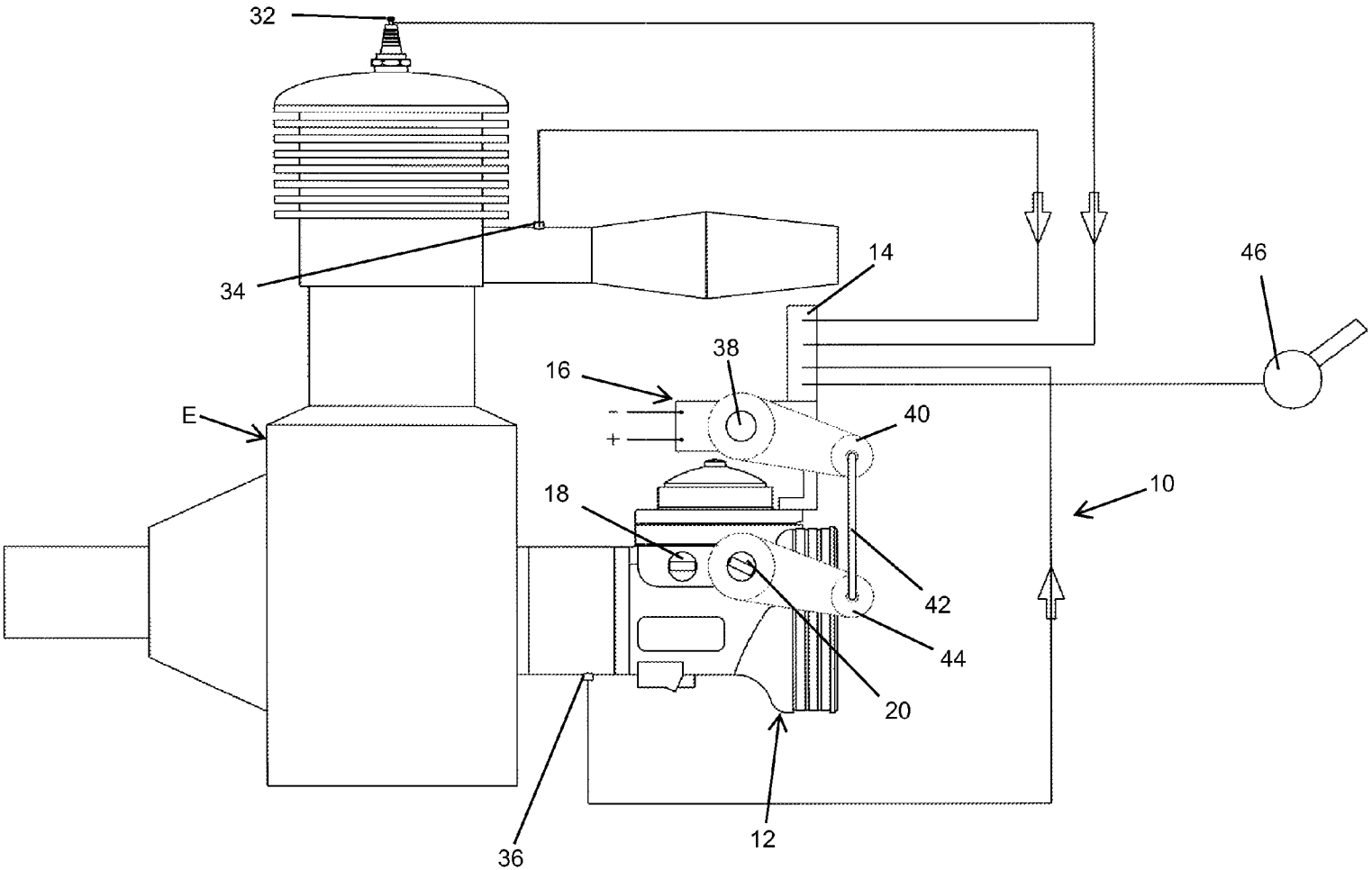
FIG. 1 illustrates a side view of an embodiment of fuel control system according to the present invention that includes a carburettor attached to an engine and having a pair of adjustment screws.
Figure 2:
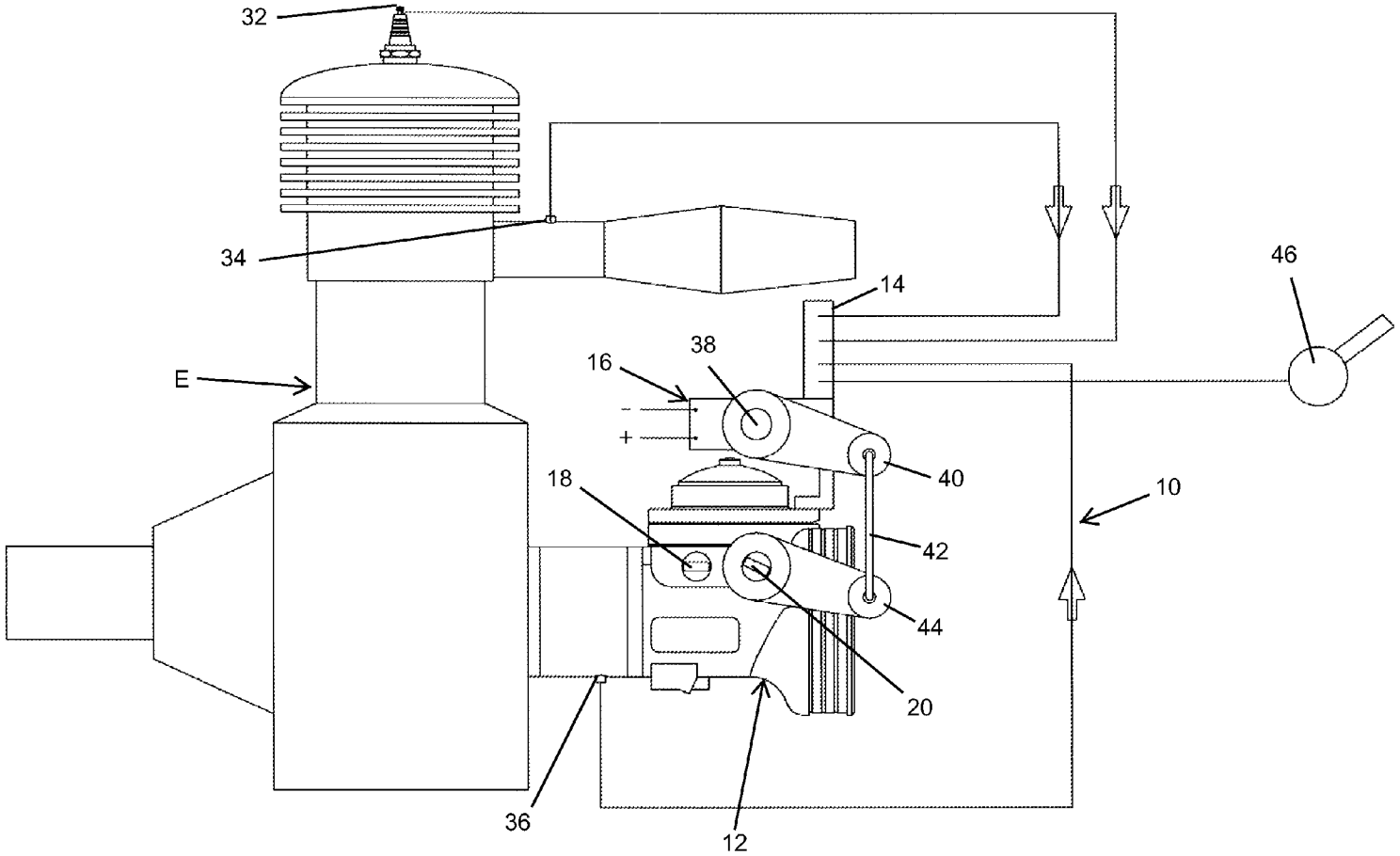
FIG. 2 illustrates a high-speed adjustment member of the carburettor in the lean adjustment range.
Figure 3:
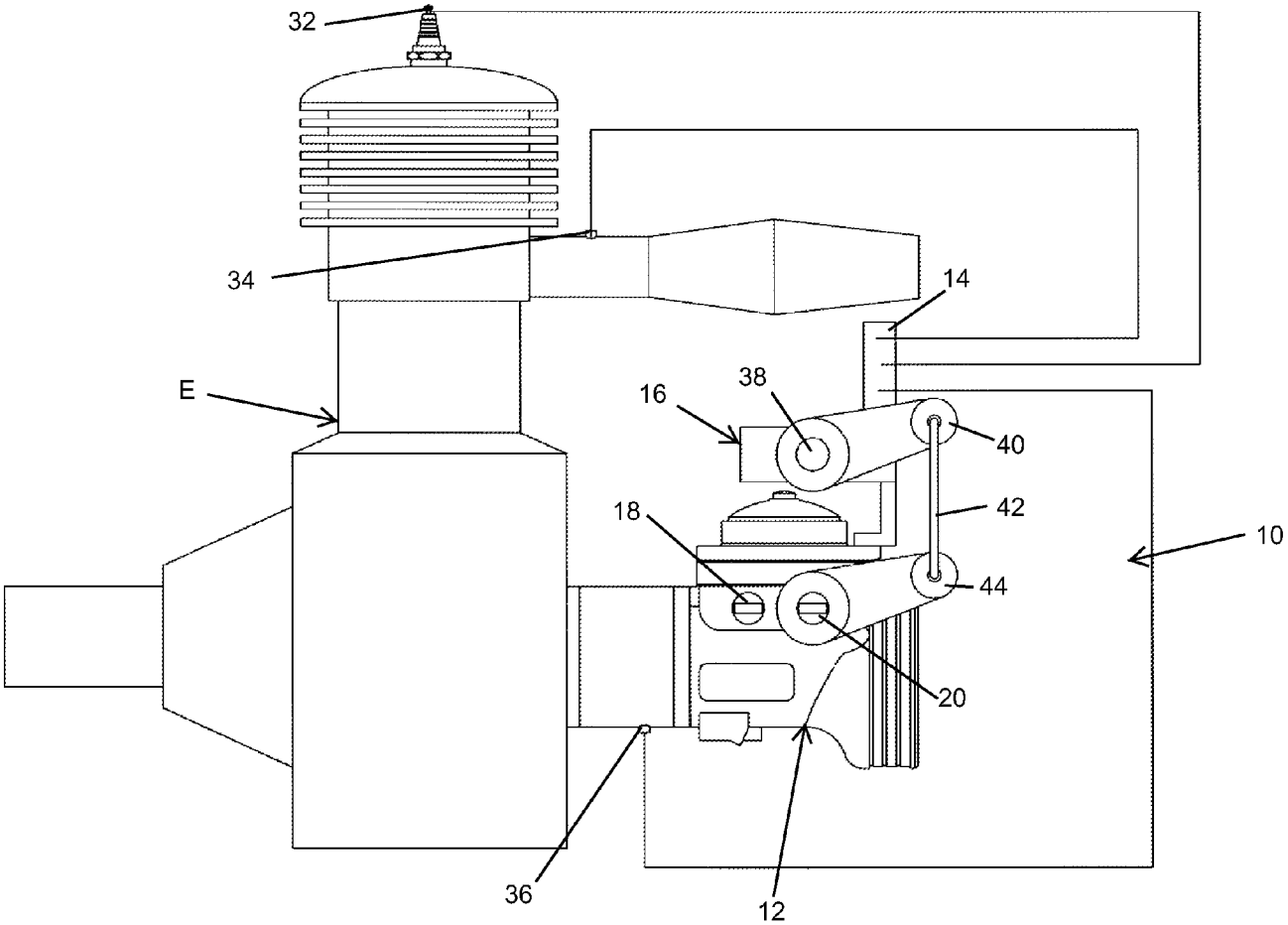
FIG. 3 illustrates the high-speed adjustment member of FIG. 2 in the rich adjustment range.
Figure 4:
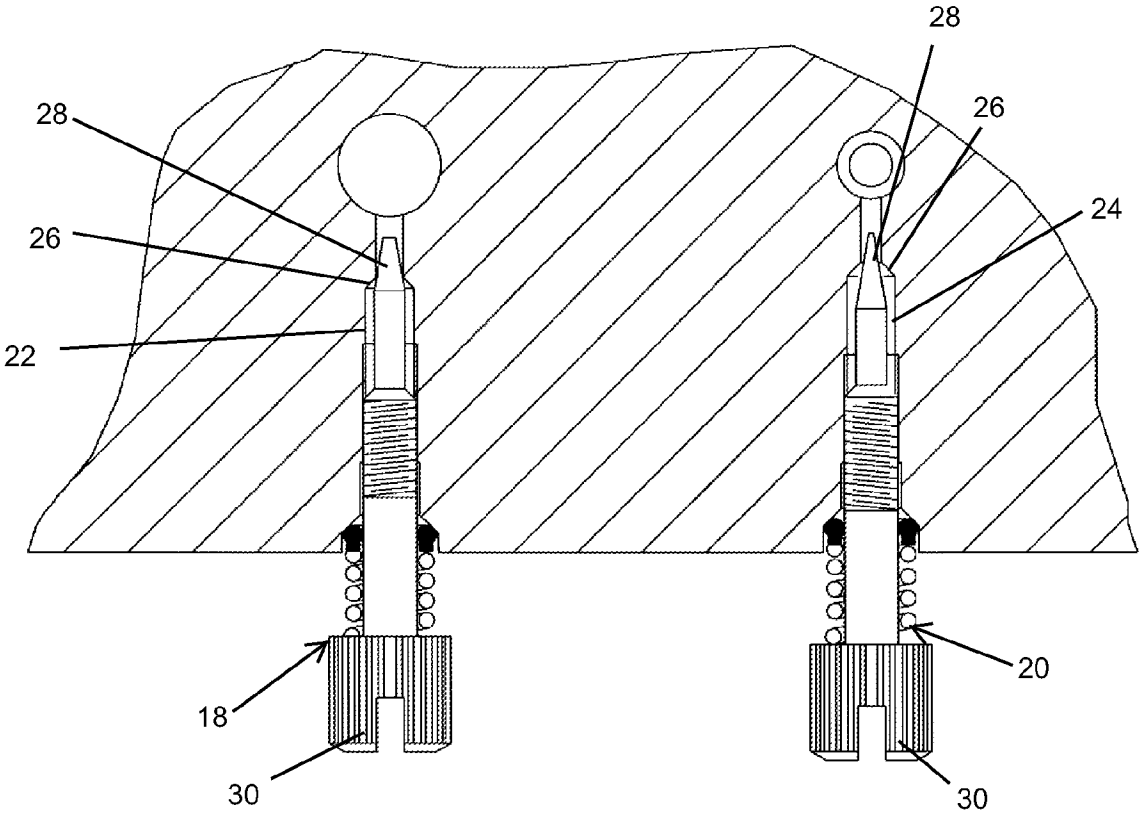
FIG. 4 illustrates an enlarged and sectioned portion of the carburettor that details the function of the adjustment screw members.

The carburettor 12 comprises both an idle speed and a high-speed fuel circuit (not shown) extending between a fuel chamber (not shown) and a throttle bore (not shown) of the carburettor 12 in conventional fashion. Metering of the flow of fuel through both of these fuel circuits can be effected through an idle speed adjustment member 18 and a high-speed adjustment member 20 which in the embodiment illustrated take the form of screw type adjusters as illustrated in FIG. 4. Naturally it will be understood that the above mentioned metering may be achieved through any other suitable means and with alternative adjusting members as required.

The adjusting members 18, 20 are seated within a respective threaded bore 22, 24 which each define a seat 26 or step change in diameter towards the inner end of the bore 22, 24. Each adjustment member 18, 20 has a tapered tip 28 which can be advanced towards or away from the respective seat 26 by turning the respective adjustment member 18. In this way the bore 22, 24 and more particularly the dimensions of the orifice defined between the seat 26 and the tapered tip 28, can be adjusted in order to meter or regulate the flow of fuel through the bore 22, 24. It will thus be appreciated that the adjustment members 18, 20 could be replaced with any other functional equivalent, which is capable of affecting the metering of the fuels in an adjustable manner.

It can be seen that the adjustment members 18, 20 each include a slotted head 30 which permits the adjustment member 18, 20 to be manually adjusted using a screwdriver or the like. Again any other means of effecting adjustment of the members 18, 20. In this way the end user of the engine E can independently adjust the metering of the idle and high-speed fuel flows to suit particular operating and/or environmental conditions. However, the fuel control system 10 also permits the automatic control of one or both of the idle and high-speed fuel flow rates. Thus the controller 14 is adapted to receive data from one or more sensors, for example a spark plug temperature sensor 32, an exhaust composition/temperature sensor 34, a manifold sensor 36, or any other suitable sensor, for example pressure, speed, or other sensors. These sensors may be hard wired to the controller 14, or may communicate wirelessly or by any other suitable manner.

Based on the information received from one or more of the sensors the controller 14 sends a signal to the actuator 16, which can then be utilised to effect rotation of, in the embodiment illustrated, the high-speed adjustment member 20 in order to meter the flow of fuel in the high-speed fuel circuit such as to suit the prevailing operation conditions as established from the data collected by one or more of the sensors. It will of course be appreciated that the actuator 16 could be utilised to control the idle speed adjustment member 18, or indeed both of the adjustment members 18, 20, whether independently or in combination. This allows the closed loop feedback control of the metering of fuel in the carburettor 12.

In the embodiment illustrated the actuator 16 comprises a motor 38 by which is driven a first lever 40 forming part of the actuator 16. The first lever 40 is connected via a link 42 to a second lever 44 whose fulcrum is coaxial with a longitudinal axis of the high-speed adjustment member 20. Thus the first lever 40 may be rotated by the motor 38, which is operated by the actuator 16, in order to effect rotation of the second lever 44. Rotation of the second lever 44 effects rotation of the high-speed adjustment member 20 in order to achieve the desired fuel flow metering. It will of course be understood that the linkage arrangement of the first and second levers 40, 44 and the connecting link 42 could be replaced with any other suitable functional alternative which will allow displacement of the adjustment member 18, 20.

Thus the high-speed adjustment member 20 (and optionally the idle adjustment member 18) can be automatically operated to allow more or less fuel to be fed to the engine via the carburettor 12, based on the information gathered by the electronic controller 14 from the various sensors.

The electronic fuel control system 10 is also preferably provided with an override in the form of a circuit breaker 46 which allows the manual and/or automatic disabling of the controller 14, wherein the actuator 16 will allow the high-speed adjustment member 20 to return to a predetermined position/configuration, for example to reset to factory settings. The actuator 16 may for example be spring based to return to this position. The fuel control system 10 may then be manually controlled by the engine operator without the input from the various sensors mounted about the engine E.

The invention claimed is:

1. An electronic fuel control system comprising a carburettor comprising a throttle bore, a fuel chamber, at least one fuel circuit extending between the fuel chamber and the throttle bore and controlled by a continuously variable rotatable adjustment member; an actuator operable to automatically adjust the adjustment member in response to one or more engine operating parameters; and a controller adapted to receive information regarding the one or more engine parameters and to effect operation of the actuator based on the received information.

2. An electronic fuel control system according to claim 1 in which the at least one fuel circuit comprises an idle fuel circuit extending between the fuel chamber and the throttle bore and controlled by an idle speed adjustment member, and a high-speed fuel circuit extending between the fuel chamber and the throttle bore and controlled by a high-speed adjustment member.

3. An electronic fuel control system according to claim 1 in which the carburettor comprises a diaphragm carburettor.

4. An electronic fuel control system according to claim 1 in which the actuator comprises a motor, a first lever driven by the motor, a second lever driving the at least one adjustment member, and a link connecting the first and second levers together.

5. An electronic fuel control system according to claim 1 comprising one or more sensors adapted to receive and transmit information regarding the one or more operating parameters to the controller.

6. An electronic fuel control system according to claim 1 in which the at least one adjustment member is operable to selectively expose/occlude an orifice in order to meter the flow of a fluid through the orifice.

7. An electronic fuel control system according to claim 1 comprising an override operable to enable a reset of the at least one adjustment member to a predetermined position.

8. An electronic fuel control system according to claim 7 comprising a controller adapted to receive information regarding the one or more engine parameters and to effect operation of the actuator based on the received information, wherein the override is adapted to manually and/or automatically deactivate the controller.

9. An electronic fuel control system according to claim 1 in which the actuator is biased to return the at least one adjustment member to a predetermined position.

10. An electronic fuel control system according to claim 1 in which the carburettor comprises a choke.

11. An electronic fuel control system according to claim 10 comprising a controller adapted to receive information regarding the one or more engine parameters and to effect operation of the actuator based on the received information, wherein the choke is operable by the controller.

12. An electronic fuel control system according to claim 10 in which the choke is remote from the carburettor.

* * * * *